US005823917A

United States Patent [19]

Chen

[11] Patent Number: 5,823,917

[45] Date of Patent: Oct. 20, 1998

[54] EXERCISING APPARATUS

[76] Inventor: Chao-Chuan Chen, No. 15, La. 9, Cheng-Kung Rd., Chin-Jung Tsun, Wu-Feng Hsiang, Taichung Hsien, Taiwan

[21] Appl. No.: 943,254

[22] Filed: Oct. 17, 1997

[51] Int. Cl.[6] ..... A63B 22/06

[52] U.S. Cl. ..... 482/57; 482/70; 482/51

[58] Field of Search ..... 482/51, 52, 53, 482/57, 70, 79, 80

[56] References Cited

U.S. PATENT DOCUMENTS

| | | | |
|---|---|---|---|
| 3,316,898 | 5/1967 | Brown | 482/51 |
| 5,383,829 | 1/1995 | Miller | 482/57 |
| 5,518,473 | 5/1996 | Miller | 482/51 |
| 5,549,526 | 8/1996 | Rodgers | 482/57 |
| 5,562,574 | 10/1996 | Miller | 482/52 |

*Primary Examiner*—Stephen R. Crow
*Attorney, Agent, or Firm*—Bacon & Thomas

[57] ABSTRACT

An improved exercising apparatus includes a supporting stand (10) that firmly stands on the floor. A pair of position-adjusting devices (30, 30') are disposed at the front end of the supporting stand (10). A roller (33) is rotationally disposed atop the position-adjusting devices (30, 30'). A pair of connecting members (50, 50') are connected to a crankshaft (41, 41') at one end. The crankshafts (41, 41') are pivotally connected to both ends of the shaft (42). The shaft (42) is connected to the supporting stand (10) by means of an extending section (421). The bottoms of the connecting members (50, 50') are moveably supported on the roller (33). The connecting members (50, 50') are provided with a pedal (51, 51') for supporting the user. By the provision of the exercising apparatus, the user may run thereon or conduct a movement which simulates mountain climbing.

3 Claims, 10 Drawing Sheets

EXERCISING APPARATUS

FIELD OF THE INVENTION

The present invention relates to an exercising apparatus, more particularly, to an improved exercising apparatus with which the user may stimulate a plurality of movements and the foot and ankle can be suitably exercised.

DESCRIPTION OF PRIOR ART

A plurality of exercising facilities has been provided. However, those exercising facilities can be merely concluded to the treadmill, or indoor bicycle, or stepping machine or mountain climbing machine, as in terms of the movements connected with the foot and leg. Nevertheless, those exercising facilities may only provide a rotational or reciprocal movement to both legs. And as a matter of fact, only a fraction, i.e. one or two, of those movements is vital to the thigh, shin, knee, or ankle. Furthermore, the existing facility can not stimulate the movement that is vital and helpful for the lower limbs.

SUMMARY OF THE INVENTION

It is the objective of this invention to provide an improved exercising apparatus wherein the thigh, shin, knee, and ankle can be effectively worked when the user conducts a movement on the exercising apparatus made according to the present invention. Besides, according to one of the aspect of the present invention, the height of the exercising apparatus can be readily adjusted such that the user may conduct a jogging and mountain climbing.

It is still the objective of this invention to provide an improved exercising apparatus in which the handrail can be folded to reduce the overall size and the storing, packing and transportation can be readily performed.

In order to achieve the objective set forth, the improved exercising apparatus includes a supporting stand that firmly stand on the floor. A pair of position-adjusting device is disposed at the front end of the supporting stand. A roller is rotationally disposed atop of the position-adjusting devices. A pair of connecting members is connected to a crankshaft at one end. The crankshafts are pivotally connected to both ends of the shaft. The shaft is connected to the supporting stand by means of an extending section. The bottom of the connecting members is moveably supported on the roller. The connecting members are provided with a pedal for supporting the user. By the provision of the exercising apparatus, the user may conduct a running thereon or conduct a movement of mountain climbing.

DETAILED DESCRIPTION OF PREFERRED EMBODIMENT

Figure 1:
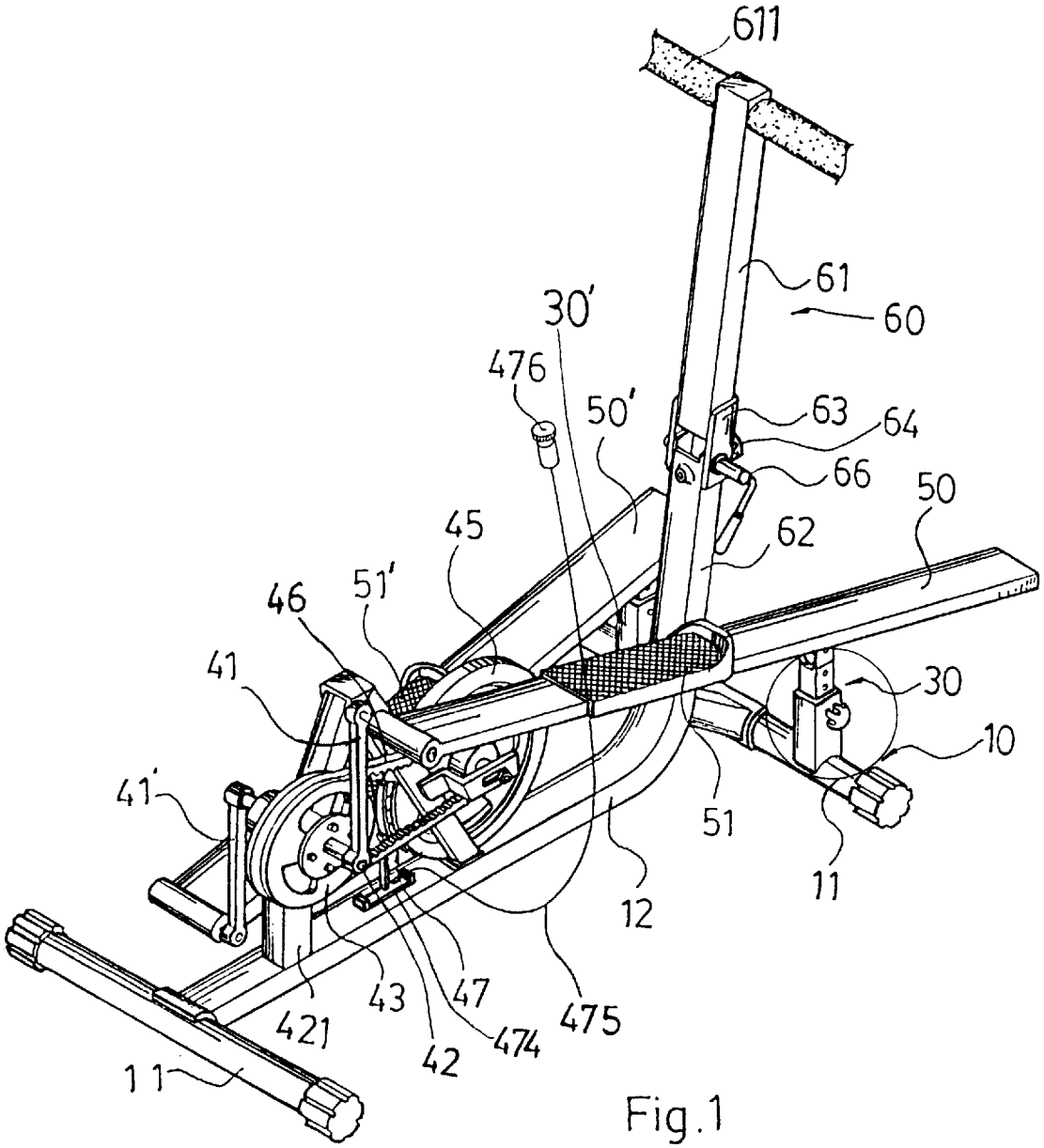
FIG. 1 is a perspective view of the exercising device made according to the present invention.
Figure 2:
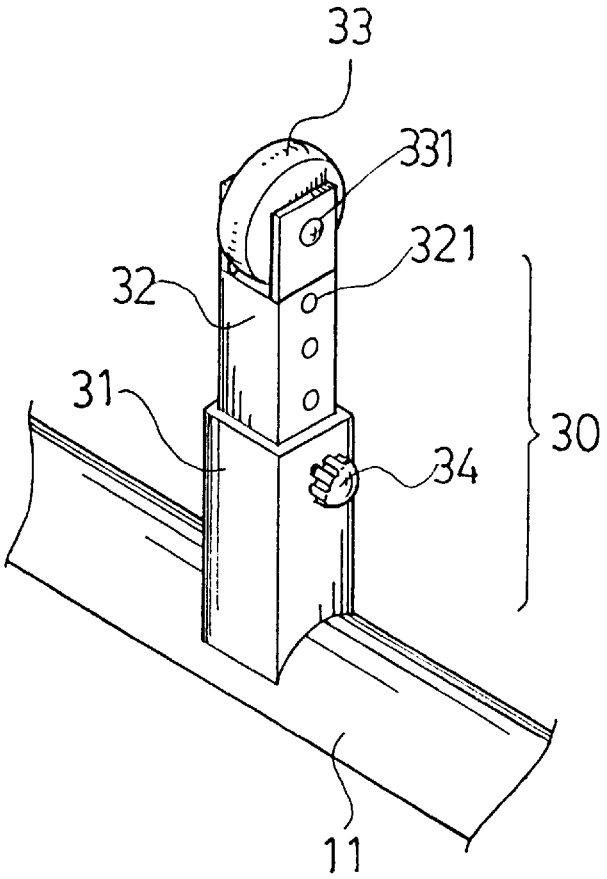
FIG. 2 is an enlarged view of the portion encircled in FIG. 1.
Figure 3:
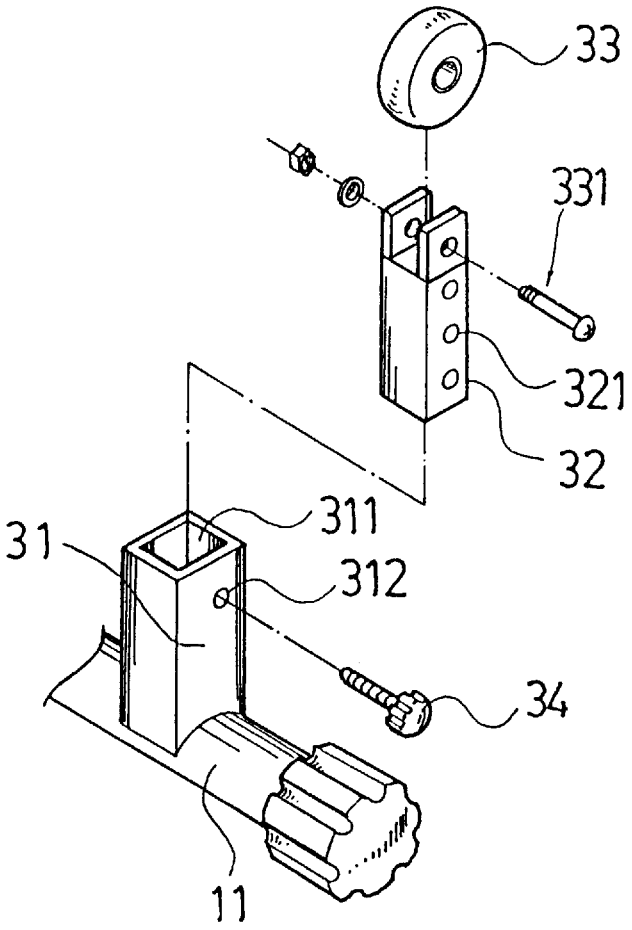
FIG. 3 is an exploded perspective view of the position-adjusting device.

Referring to FIGS. 1, 2, 3, 4A and 4B, the exercising device made according to the present invention generally comprises a supporting stand 10 that includes a pair of footings 11 that are connected by means of a linking rod 12.

A pair of position-adjusting device 30, 30' are disposed at the front footing 11. The positioning-adjusting 30 includes a supporting barrel 31 that is vertically attached to the end portion of the footing 11. The supporting barrel 31 defines an opening 311 atop. A pair of opposite sidewalls of the barrel 31 is provided with a through hole 312 that is adjacent to the opening 311. An extending tube 32 is moveably received within the supporting barrel 31 and the side walls of the extending tube 32 are provided with positioning holes 321 which can be aligned with the through hole 312 of the supporting barrel 31. When the through hole 312 is aligned with one of the positioning hole 321, a locking pin 34 can be inserted thereof such that the extending rod 32 can be fixedly positioned respect to the supporting barrel 31. A roller 33 is rotationally disposed at top of the extending rod 32 by means of a pin shaft 331. The roller 33 is freely rotated thereof.

A steps-controlling assembly 40 including a pair of crankshafts 41, 41' is provided. The fixing end of the steps-controlling assembly 40 is pivotally connected to both ends of a shaft 42. The shaft 42 is connected to the linking rod 12 by means of an extending section 421. The crankshaft 41 that is rotated with the shaft 42 is provided with a disk 43. The extending section 421 is extended toward the exercising device and forms a fixing bracket 44. A loading wheel 45 is rotationally disposed between the fixing bracket 44. A linking element 46 is applied to connect the loading wheel 45 and the disk 43. The linking element 46 can be embodied by chains or a belt. By the linking of the linking element 46, the loading wheel 45 and the disk 43 can be moved simultaneously. The linking rod 12 is provided with a damping device 47 in the position under the loading wheel 45. The damping device 47 may apply a resistance or pressure on the peripheral of the loading wheel 45. Accordingly, a working load that is opposite to the rotational direction of the loading wheel 45 will be generated.

In one of the embodiment of the damping device 47, it includes a magnet stand 471 in which a plurality of magnets 472 is fixedly disposed thereof. A linking rod 473 that is attached to a fixing stand 474 is connected with the magnet stand 471. The other end of the linking rod 473 is connected with a speed-regulating knob 476. By the adjustment of the regulating knob 476, the distance between the magnets 472 and the loading wheel 45 can be adjusted. As a result, the magnetic force applied to the loading wheel 45 can be adjusted; i.e. the working load to the loading wheel 45 is adjusted.

Figure 5:
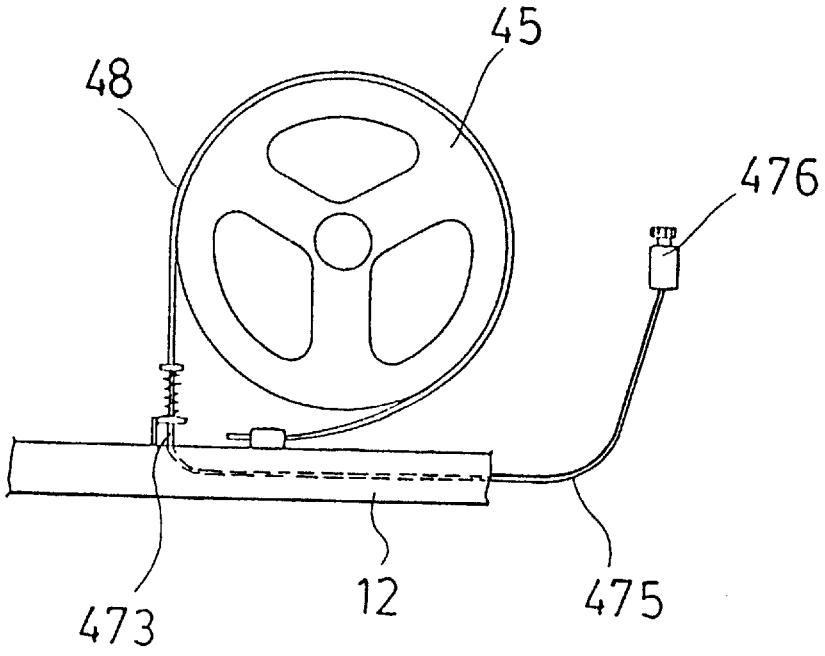
FIG. 5 is a front view of another damping device.

Referring to FIG. 5, another damping device is described. This damping device can be also connected to the disk 43, the loading wheel 45, the cable 475, and the regulating knob 476. However, no magnets stand 471 and the magnets 472 are mounted. Instead, a braking band 48 that routes about two third perimeter of the loading wheel 48 is provided. One end of the braking band is fixedly connected to the linking rod 12, while the other end is connected to the cable 475. By the adjustment of the regulating knob 476, the braking force applied to the perimeter of the loading wheel 45 can be readily adjusted. Accordingly, the braking force applied from the braking band 48 will limit the rotation of the loading wheel 45 as the direction of the braking force is opposite to the rotation of the loading wheel 45.

A pair of connecting members 50, 50' is provided. One end of the connecting members 50, 50' is connected to the crankshafts 41, 41' while the bottom of the connecting members 41, 41' is disposed onto the roller 33 of the position-adjusting device 30, 30'. The connecting members 50, 50' is provided with a pedal 51, 51' for supporting the feet of the user.

Figure 6:
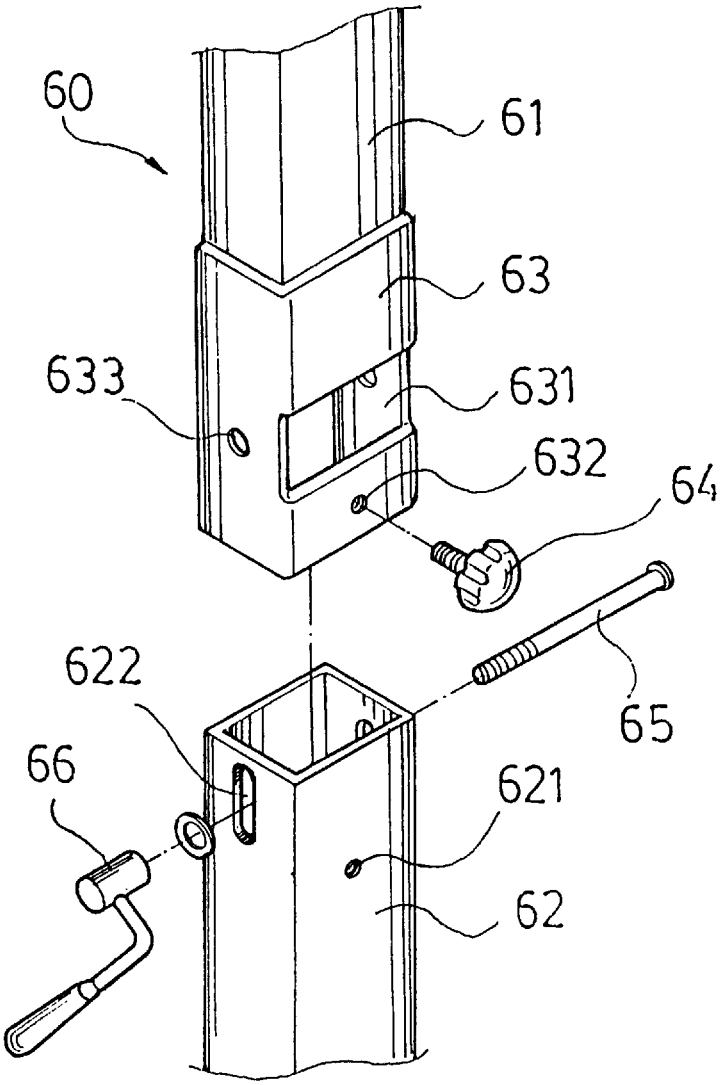
FIG. 6 is an exploded perspective view of the handrail joint.
Figure 7A:
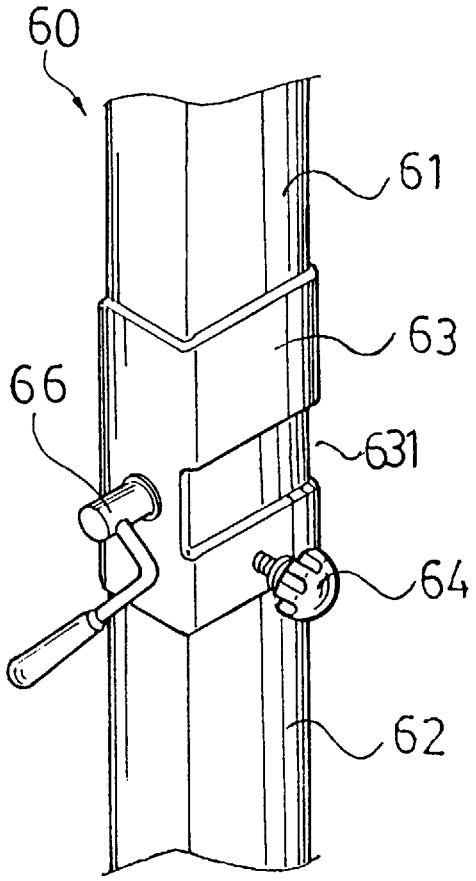
FIG. 7A is a perspective view of the handrail joint.
Figure 7B:
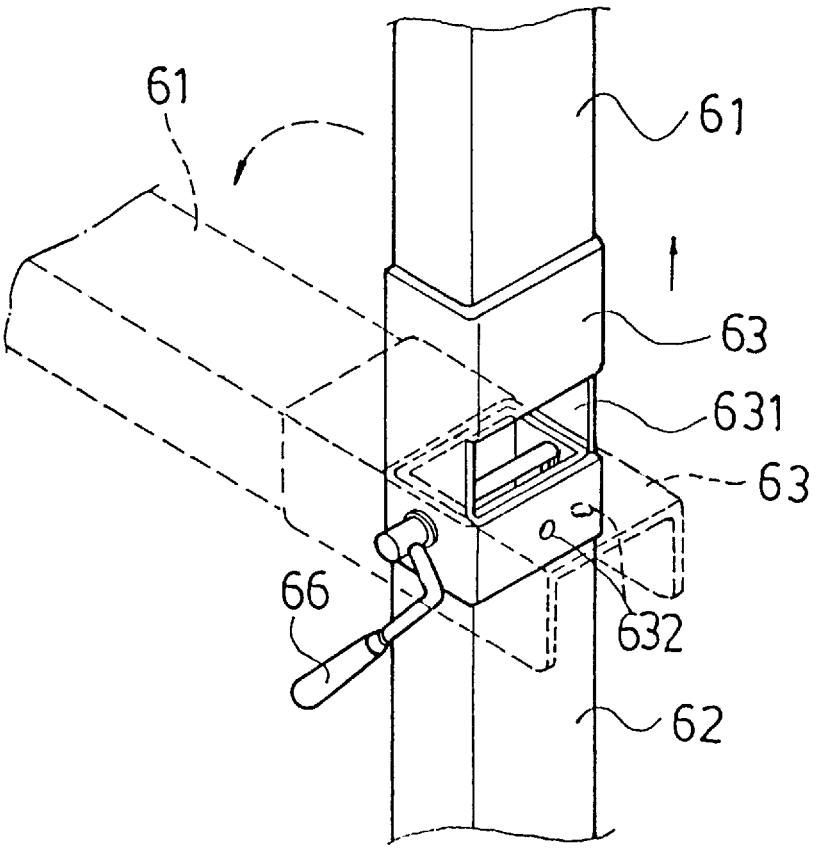
FIG. 7B is a schematic illustration showing the folding of the handrail joint.
Figure 8:
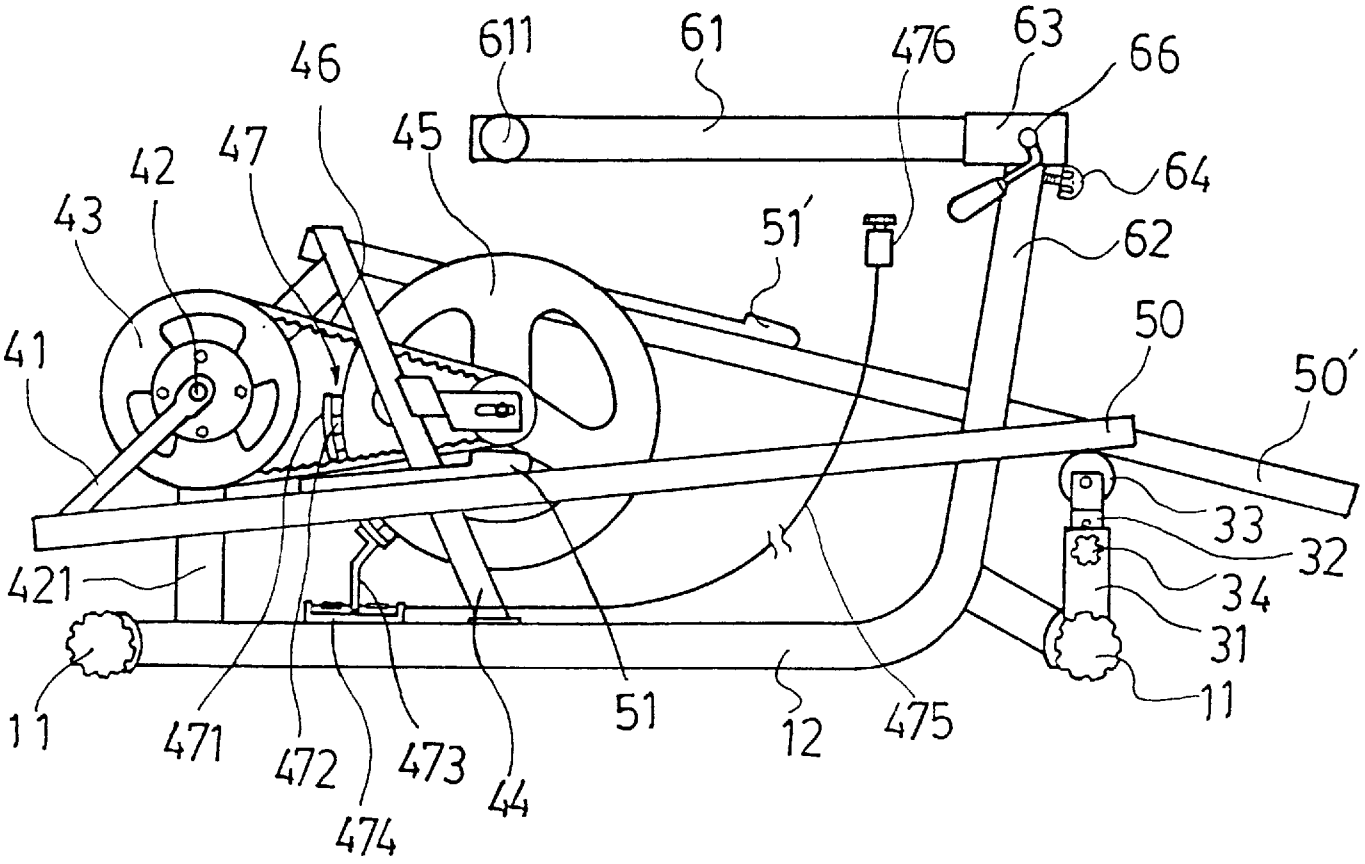
FIG. 8 is a schematic illustration showing the folding of the exercising device.

Referring to FIGS. 6 to 8, a handrail 60 is provided and which includes a first rod 61 and a second rod 62. The second rod 62 is an extension from the linking rod 12 and which is bent upward. The top of the first rod 61 is provided with a handgrip 611 that can be embodied with different shape or style. The facing ends of the first and second rods 61, 62 are enclosed with an enveloping clip 63 that is provided with an opening 631 having a certain ratio. One end of the enveloping clip 63 is connected to the lower end of the first rod 61 and the other end of the enveloping clip 63 is provided with a hole 632 which is corresponding to a hole 621 of the second rod 62. A fastening member 64 can be inserted into those two holes 632, 621 such that the first and second rods 61 and 62 can be connected. The side portions of the enveloping clip 63 and the top of the second rod 62 are provided with a hole 633 and an oblong hole 622, respectively. A bolt 65 having threaded portion can be inserted into the hole 633 and oblong hole 622 and the first and second rods 61 and 62 can be fixedly connected when a fastening handle 66 is engaged thereof. The first rod 61 is bent downward. The first rod 61 is bent in a manner that the fastening member 64 and the fastening handle 66 can be removed and released. The first rod 61 can be moved upward for a suitable distance and when the bolt 65 is moved to the upper limit of the oblong hole 622 of the second rod 62, it is the limit. In this event, a gap is generated between the first and second rods 61, 62 and the first bend 61 can be bent downward. Since the enveloping clip 63 is fixedly connected to the first rod 61, the direction of the enveloping clip 63 will be changed together with the change of the first rod 61. Besides, when the direction is changed horizontally or vertically, the enveloping clip 63 can be readily moved on the top of the second rod 62.

Figure 4A:
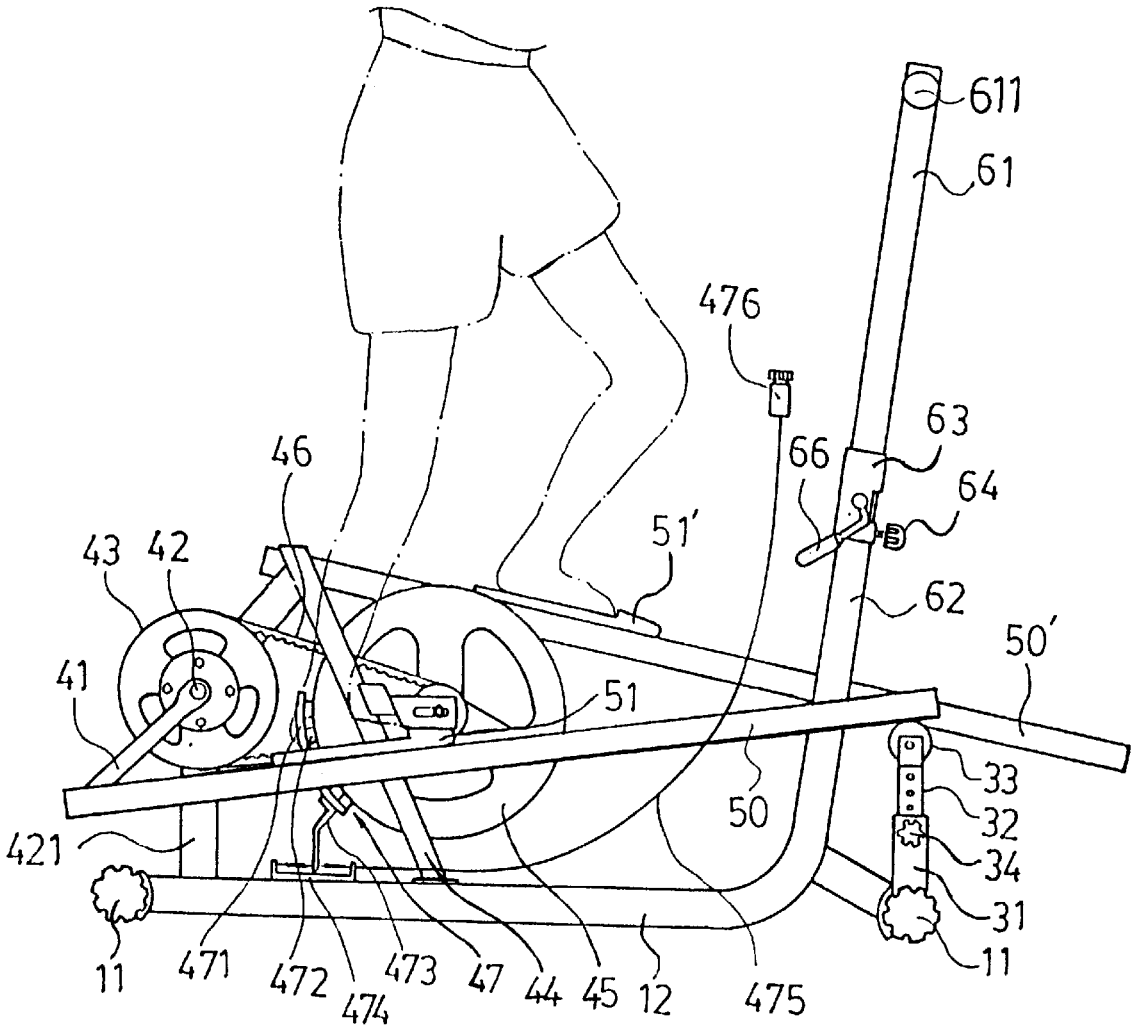
FIG. 4A is a side elevation view of the exercising device.
Figure 4B:
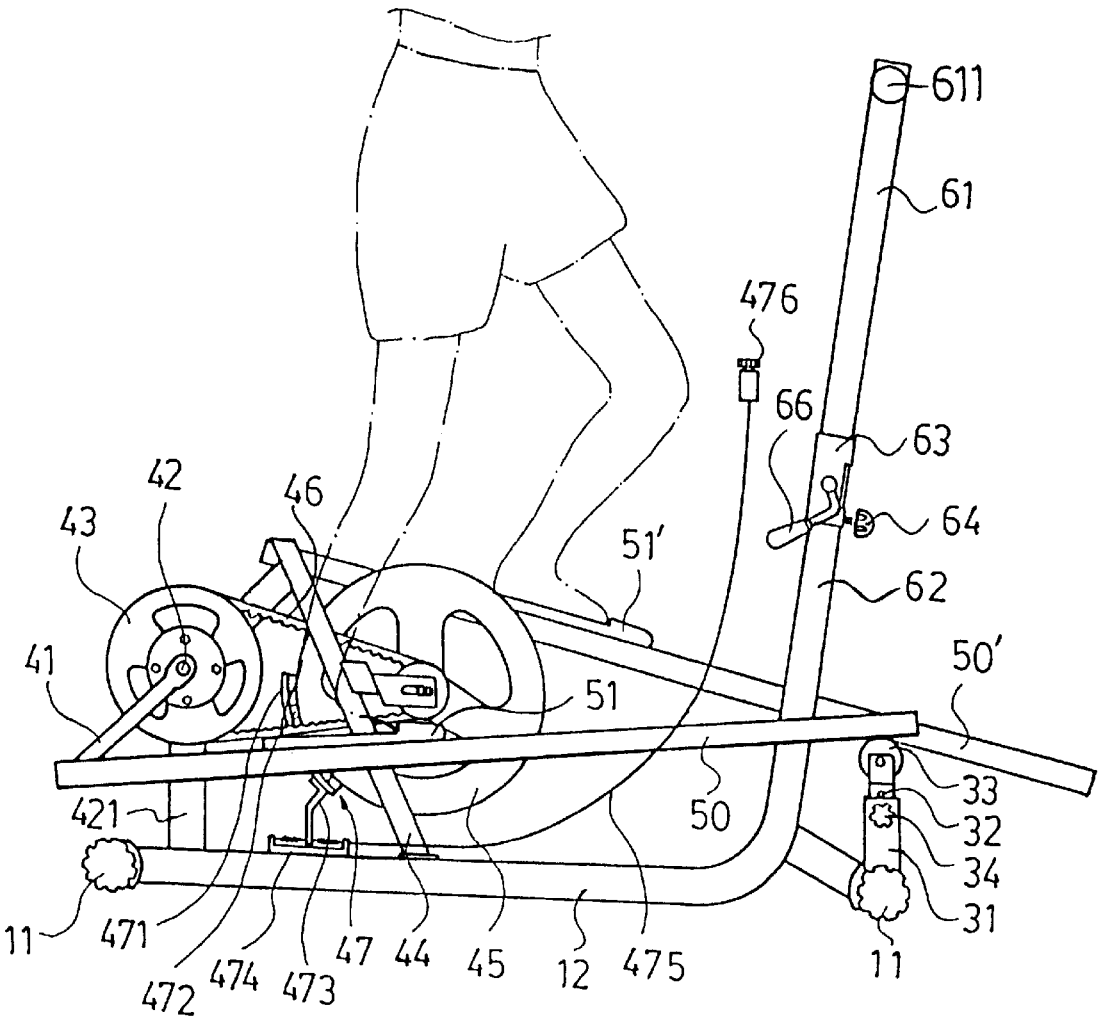
FIG. 4B is still a side elevation view of the exercising device.

Referring to FIGS. 4A and 4B, the user may step onto the pedals 51, 51' while hold on the handgrip 611 of the handrail 60. In this posture, the connecting members 50, 50' can be readily controlled by the feet and legs and the crankshafts 41, 41' connected thereof can be oscillated. On the other hand, the front end of the connecting members 50, 50' can be moved linearly and reciprocally over the rollers 33. During the movement as described above, when the free end of the crankshafts 41, 41' is moved from the lowest position to the highest position, the rear end of the connecting members 50, 50' that are pivotally connected thereof will repetitively moved within a range that is two times of both the height and length of the crankshaft 41, 41'. In this case, the upper and lower inclining angles of the front end of those two connecting members 50, 50' will be repetitively changed upward and downward.

From the above description, it can be readily understand that the connecting members 50, 50' are periodically disposed in a front high rear low, front low rear high, and an oscillating movement. Accordingly, the knee joint and humerus joint can be suitably exercised. Besides, a movement of foot as centered on the toe can be performed. By doing this movement, the ankle and rear shank can be readily exercised. Most important, by the adjustment of the position-adjusting device 30, 30', the front height of the connecting members 50, 50' can be conveniently adjusted. When the user manipulates the connecting members 50, 50' backward, the front end of the connecting members 50, 50' is higher than the rear end that is pivotally connected with the crankshafts 41, 41'. In this case, the foot is disposed in an inclined surface and this stimulates the mountain climbing. The higher the position-adjusting device 30, 30', the steeper the connecting members 50, 50' are. The more energy the user may exhaust. Besides, the handrail 60 can be folded to reduce the bulky size during the transportation, packing and storing.

What I claim is:

1. An improved exercising device, comprising:

a supporting stand (10) for being firmly supported on the floor, a steps-controlling assembly (40) being disposed at the central portion of the supporting stand (10), said supporting stand (10) including a disk (43) and a loading wheel (45), a driving element (46) that has a loop configuration is used to connect said disk (43) and said loading wheel (45), said exercising devices further comprising:

a pair of position-adjusting devices (30, 30') being disposed at the front portion of said supporting stand (10), said positioning-adjusting (30) including a supporting barrel (31) and an extending tube (32) that is telescopically and moveably received within said supporting barrel (31), said supporting barrel (31) being vertically connected to said supporting stand (10) and a roller (33) being rotationally disposed at the top of said extending tube (32), said roller (33) being freely rotated;

a damping device (47) being disposed with respect to said loading wheel (45) and providing a working load to said loading wheel (45); and a pair of connecting members (50, 50'), one end of said connecting members (50, 50') being connected to said crankshafts (41, 41') while the bottom of said connecting members (41, 41') being disposed onto said roller (33) of said position-adjusting device (30, 30'), said crankshafts (41, 41') being pivotally attached to the shaft of said disk (43), said connecting members (50, 50') being further provided with a pedal (51, 51') for supporting the feet of the user.

2. An improved exercising apparatus as recited in claim 1, wherein said supporting barrel (31) of said position-adjusting device (30, 30') includes a supporting barrel (31) that is rectangular, and defines an opening (311) atop, a pair of opposite sidewalls of said barrel (31) being provided with a through hole (312) that is adjacent to said opening (311), and said extending tube (32) being moveably received within said supporting barrel (31) and the side walls of said extending tube (32) being provided with positioning holes (321) which can be aligned with said through hole (312) of said supporting barrel (31), wherein when said through hole (312) is aligned with one of said positioning hole (321), a locking pin (34) can be inserted thereof such that said extending rod (32) can be fixedly positioned respect to said supporting barrel (31).

3. An improved exercising apparatus as recited in claim 1, wherein a handrail (60) is provided and which includes a first rod (61) and a second rod (62), said second rod (62) being fixedly attached to said supporting stand (10), the facing ends of said first and second rods (61, 62) being enclosed with a U-shaped enveloping clip (63) that is provided with an opening (631) one end of said enveloping clip (63) being connected to the lower end of said first rod (61) and the other end of said enveloping clip (63) being provided with a hole (632) which corresponds to a hole (621) of said second rod (62), a fastening member (64) inserted into said two holes (632, 621) such that said first and second rods (61, 62) connected vertically, the side portions of said enveloping clip (63) and the top of said second rod (62) being provided with a hole (633) and an oblong hole (622), respectively, a bolt (65) having threaded portion are inserted into said hole (633) and said oblong hole (622) and said first and second rods (61, 62) are fixedly connected when a fastening handle (66) is engaged thereof and said first rod (61) can be bent downward.

* * * * *